United States Patent [19]

Grimm

[11] 4,367,050

[45] Jan. 4, 1983

[54] VERY THIN ELECTROMECHANICAL WATCH

[75] Inventor: Maurice Grimm, Neuchatel, Switzerland

[73] Assignee: Ebauches S.A., Neuchatel, Switzerland

[21] Appl. No.: 215,605

[22] Filed: Dec. 12, 1980

Related U.S. Application Data

[63] Continuation of Ser. No. 69,587, Aug. 24, 1979, abandoned.

[30] Foreign Application Priority Data

Sep. 21, 1978 [CH] Switzerland ..... 9854/78

[51] Int. Cl.[3] ..... G04B 19/04; G04C 23/02

[52] U.S. Cl. ..... 368/80; 368/88

[58] Field of Search ..... 368/76, 77, 80, 88, 368/155, 157, 159, 160, 204, 220, 223, 276, 299, 300, 318

[56] References Cited

U.S. PATENT DOCUMENTS

| | | | |
|---|---|---|---|
| 2,248,195 | 7/1941 | Prins | 368/77 |
| 2,466,312 | 4/1949 | Heintz | 368/77 |
| 2,852,908 | 9/1958 | Stern et al. | 368/77 |
| 3,587,223 | 6/1971 | Zatsky | 368/76 |
| 3,676,993 | 7/1973 | Berger et al. | 58/23 |
| 3,934,401 | 1/1976 | Wood | 368/88 |
| 4,092,820 | 6/1978 | Kume et al. | 368/76 |
| 4,201,040 | 5/1980 | Nakayama | 368/300 X |

FOREIGN PATENT DOCUMENTS

| | | | |
|---|---|---|---|
| 1246200 | 10/1960 | France . | |
| 2204297 | 5/1974 | France . | |
| 52-67364 | 3/1977 | Japan | 368/88 |
| 151 | 1/1889 | Switzerland . | |
| 343319 | 1/1960 | Switzerland | 368/76 |

*Primary Examiner*—Vit W. Miska

*Attorney, Agent, or Firm*—Silverman, Cass & Singer, Ltd.

[57] ABSTRACT

Extra-flat electromechanical watch, in which the dial is situated substantially at mid-height of the watch. The elements of the movement are situated, in a radial direction, beyond the space of the passage of the hands (26) and, in elevation, partially at the level of the passage of the hands. This arrangement permits the realization of a watch the thickness of which is about 2 mm, for example.

8 Claims, 7 Drawing Figures

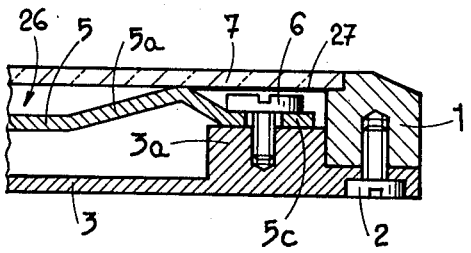
FIG. 4
FIG. 5
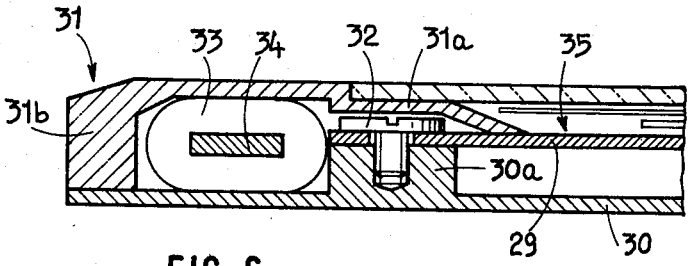
FIG. 6
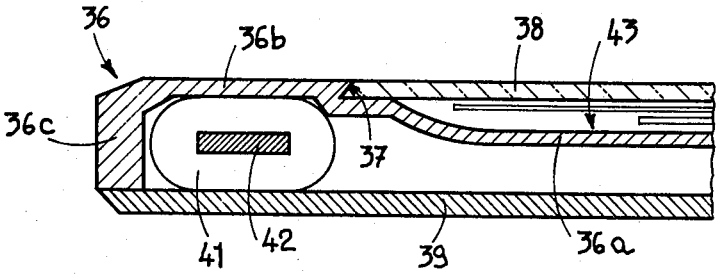
FIG. 7
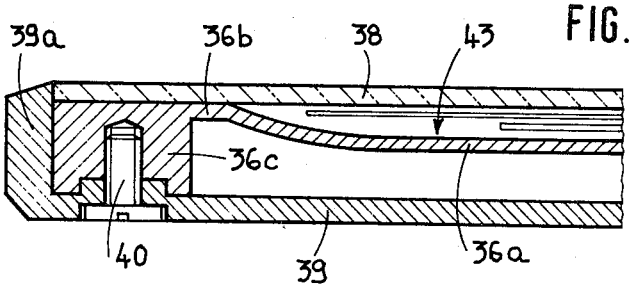

VERY THIN ELECTROMECHANICAL WATCH

This is a continuation of application Ser. No. 69,587, filed Aug. 24, 1979, now abandoned.

BACKGROUND OF THE INVENTION

The present invention relates to an extra-thin electromechanical watch.

The purpose of the present invention, namely the realization of an extra-thin electromechanical watch having a thickness of the order of 2 mm (millimeters) for example, is attained by a judicious arrangement of the elements of the watch with respect to one another.

SUMMARY OF THE INVENTION

An extra flat electromechanical watch is formed by locating the elements of the movement such as the battery, timing circuit and motor laterally of the display hands and at least partially at the level of the display hands.

BRIEF DESCRIPTION OF THE DRAWINGS

The drawing shows, by way of example, an embodiment of the invention and two modifications thereof.

FIG. 4 is a cross-sectional view of a detail, along the line IV—IV of FIG. 1, still at an enlarged scale.

FIG. 5 is a cross-sectional view corresponding to the view of FIG. 2, of a first modification.

FIG. 6 is a cross-sectional view also corresponding to the view of FIG. 2, of a second modification, and FIG. 7 is a cross-sectional view of the same modification along a direction perpendicular to that of FIG. 6.

DESCRIPTION OF THE PREFERRED EMBODIMENT

Figure 1:
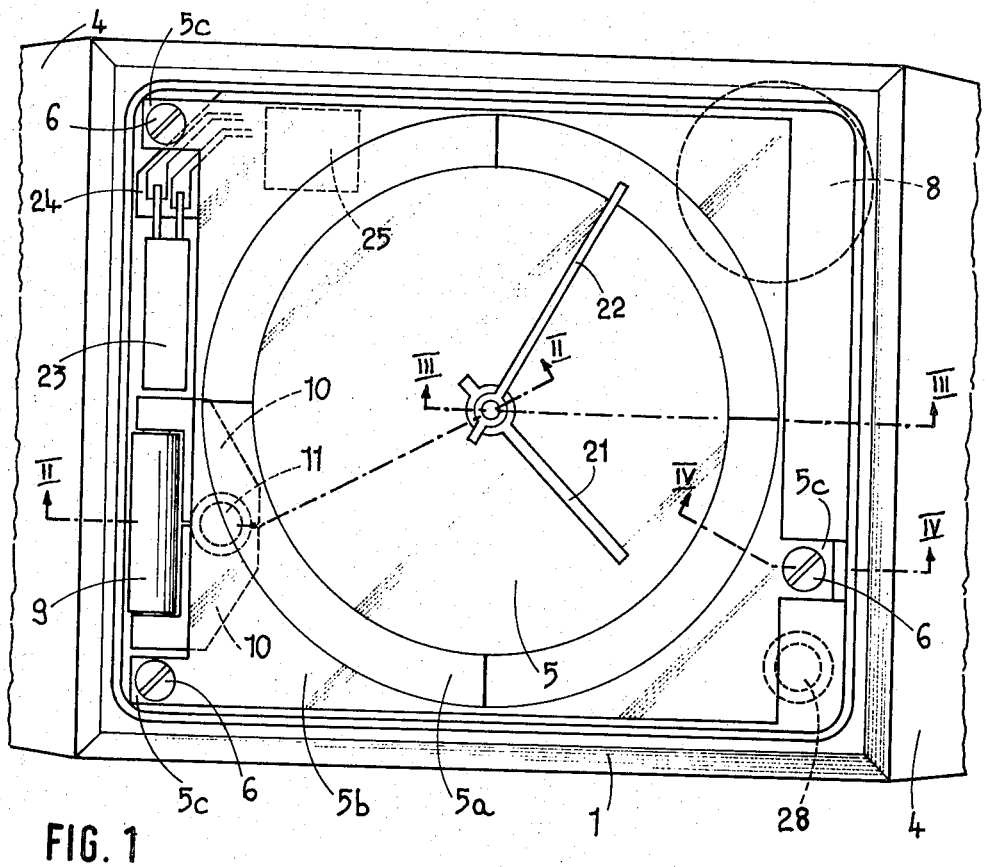
FIG. 1 is a plan view of an extra-thin electromechanical watch.
Figure 2:
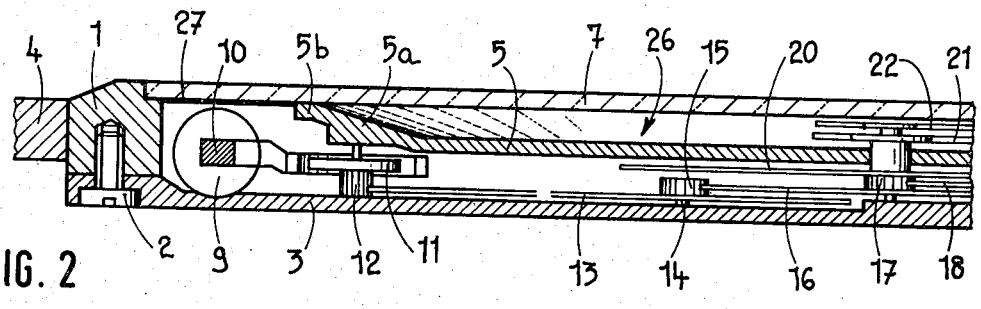
FIG. 2 is a cross-sectional view along the line II—II of FIG. 1, at an enlarged scale.

The watch illustrated in FIGS. 1 or lateral face to 4 comprises a case consisting of a combined caseband and bezel 1 or lateral face to which a back 3 or back face is secured by means of screws 2 (FIGS. 2 and 4). A wristlet 4 is welded to the combined caseband and bezel 1. These several elements, namely the combined caseband and bezel, the back and the wristlet, are made of gold or other metal. One of the elements—back and caseband—may be provided with circular ridges, coaxial with the screws 2, engaging corresponding recesses of the other element so as to ensure a good centering of one element with respect to the other.

The frame of the movement comprises two plates one of which is formed by the back 3 and the other one by dial 5, also made of gold. The dial 5 is cup-shaped, a frustoconical zone or wall 5*a* separating its peripheral portion or plate 5*b* from its central portion which is situated substantially at mid-height of the watch. This dial presents a plurality of tongues 5*c* traversed by fastening screws 6 engaging blocks 3*a* integral with the back 3. A crystal 7 or front face consists of a thin plate made of a very hard material, for instance of hardened mineral glass or of sapphire, stuck or pushed in the combined caseband and bezel 1.

The elements of the movement are constituted, among others, by a battery 8, situated in an angle or corner of the case and by a stepping motor the coil of which is designated by the reference numeral 9, and the pole shoes by the reference numeral 10. The motor comprises a rotor 11 mounted between the back 3, on the one hand, and the dial 5, on the other hand. This rotor is rigidly connected with a pinion 12 meshing with the wheel 13 of an intermediate demultiplying part turning on a stud 14 carried by the back 3. The pinion 15 of this intermediate part meshes with a minute wheel 16 rigidly connected with a pinion 17 engaging the wheel 18 of a dial-train wheel 18, rotatively mounted on the dial 5, the pinion of which, designated by the reference numeral 19, meshes with an hour wheel 20. The hours and minutes hands are designated by the reference numerals 21 and 22, respectively. Other elements of the movement are constituted by a resonator including a quartz crystal 23; by a partially visible printed circuit 24, illustrated in FIG. 1; and by an integrated circuit 25 carried by said printed circuit 24. The integrated circuit 25 includes, as this is known in this type of watch, a circuit for sustaining the oscillations of the quartz crystal 23, a circuit dividing the frequency of these oscillations and a circuit controlling the motor which is actuated by the output pulses of the frequency divider. In the vertical direction, the elements of the movement, particularly the coil 9 of the stepping motor, are situated partially at the level of the passage of the hands, designated by the reference numeral 26, and, in a radial or lateral direction, beyond the latter.

Figure 3:
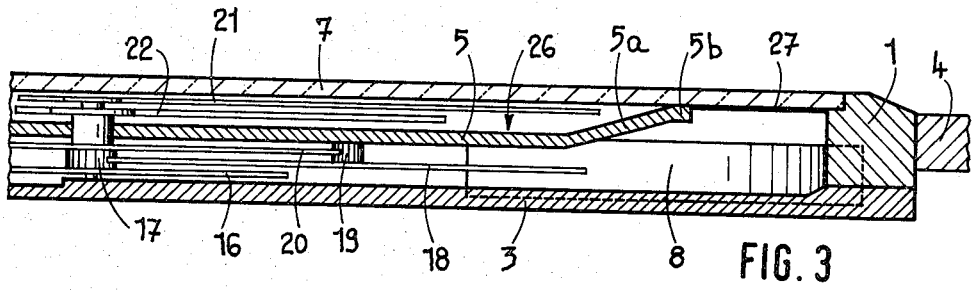
FIG. 3 is a cross-sectional view along the line III—III of FIG. 1, also at an enlarged scale.

It should be noted that the crystal 7 is provided with an opaque peripheral portion, not shown in FIG. 1, serving to mask the elements of the movement not hidden by the dial as well as the portions of the latter which are situated beyond its frustoconical zone 5*a*. This opacity of the crystal can be obtained either by a suitable treatment of the crystal, or, as illustrated in FIGS. 2, 3 and 4, by the use of an inner metallized layer 27 the thickness of which has been exaggerated in the drawing.

The watch as described and illustrated is provided with a control pusher or push button schematically represented as at 28 in FIG. 1, which is accessible on the side of the back 3, and which serves for setting the hands.

The modification of FIG. 5 differs from the first embodiment mainly by the fact that the dial, reference numeral 29 is situated substantially at mid-height of the watch, is plane, and is not cup-shaped. This dial constitutes one of the plates of the frame of the movement, the second plate being formed by the back 30. The peripheral portion of the dial 29 is covered by the portion a wall 31*a* of a combined caseband and bezel 31, constituting the case body, the peripheral portion 31*b* of which, forming the caseband, is secured to the back 30 by screws which are not illustrated. The back is provided with blocks 30*a* with which cooperate mounting screws 32. The coil 33 and the pole shoes 34 of the stepping motor are situated beyond the space of the passage of the hands, designated by the reference numeral 35, and partially at the level of the passage of the hands.

In the embodiment of FIGS. 6 and 7, the dial, designated by the reference numeral 36*a*, is made integral with the case body 36, the portion 36*b* of which (FIG. 6) forms the bezel, whereas its portion 36*c* forms the caseband. Two rectilinear slide-ways or guides 37, parallel to each other, only one of which is visible in the drawing (FIG. 6), are provided in the bezel 36*b* and receive the crystal 38, the crystal 38 having two opposite edges which are bevelled to this end. The lateral displacements of the crystal in the guides 37 are prevented by two opposite flanges 39*a* of the back 39 extending up to the level of said crystal (FIG. 7). The back 39 and the case body 36 are assembled together by means of screws 40. The coil 41 and the pole shoes 42 of the stepping motor are situated radially, beyond the space of the passage of the hands 43 and, in the vertical direction, partially at the level of the passage of the hands.

In this modification, the dial 36*a* constitutes, as in the first embodiment and in the modification of FIG. 5, a plate of the frame of the movement, said frame including a second plate constituted by the back of the case. In both modifications, the case body may carry the attachments of the wristlet or they may be welded directly to the case body.

What I claim is:

1. An extra thin electromechanical watch comprising:

a case having a front face, a back face and a lateral face interconnecting said front and back faces, said front and back faces being substantially plane and parallel, at least a part of said front face consisting of a transparent glass plate;

a dial comprising a plate substantially parallel to and located between said front and back faces and a wall connecting the periphery of said plate with said front face;

at least two hands for displaying time, located within a space delimited by said plate, said wall and said front face;

a gear train for moving said hands, substantially completely located in a zone between said plate and said back face; and motor means including a coil for driving said gear train, electric power means including a battery for powering said motor means, and control means including a crystal resonator for controlling said motor means, said coil, battery and crystal resonator being located substantially completely out of said zone and between said wall, said lateral face and said front face, at least one of said coil, battery and crystal resonator having a part at the level of the plane of said dial plate.

2. The extra-thin watch as claimed in claim 1, wherein said gear train is mounted on said back face.

3. The extra-thin watch as claimed in claim 1 wherein said gear train is mounted between said back face and said plate.

4. The extra-thin watch as claimed in claims 1, 2 or 3, wherein said plate is located substantially at half of the distance between said front and back faces.

5. The extra-thin watch as claimed in claim 1, wherein said wall is frusto-conical in shape and integral with said plate, said plate and said wall forming a cup-shaped dial.

6. The extra-thin watch as claimed in claim 11, wherein said wall is integral with said front face.

7. The extra-thin watch as claimed in claim 1, wherein said front face consists of a glass plate with a transparent portion facing said dial and a non-transparent portion for hiding said motor means, said electric power means and said control means.

8. The extra-thin watch as claimed in claim 1 in which the thickness of the watch is about 2 millimeters.

* * * * *